US008127794B2

(12) United States Patent
Xie et al.

(10) Patent No.: US 8,127,794 B2
(45) Date of Patent: Mar. 6, 2012

(54) DISPENSER ARRANGEMENT FOR FLUIDIC DISPENSING CONTROL IN MICROFLUIDIC SYSTEM

(75) Inventors: Ling Xie, Singapore (SG); Chirayarikathuveedu Sankarapillai Premachandran, Singapore (SG); Ser Choong Chong, Singapore (SG)

(73) Assignee: Agency for Science, Technology and Research, Singapore (SG)

( * ) Notice: Subject to any disclaimer, the term of this patent is extended or adjusted under 35 U.S.C. 154(b) by 464 days.

(21) Appl. No.: 12/441,963

(22) PCT Filed: Sep. 19, 2006

(86) PCT No.: PCT/SG2006/000276

§ 371 (c)(1), (2), (4) Date: Mar. 19, 2009

(87) PCT Pub. No.: WO2008/036045

PCT Pub. Date: Mar. 27, 2008

(65) Prior Publication Data

US 2010/0084032 A1 Apr. 8, 2010

(51) Int. Cl.
*F15C 1/00* (2006.01)
*B67D 7/06* (2010.01)

(52) U.S. Cl. ..... 137/825; 137/831; 137/832; 137/833; 222/80

(58) Field of Classification Search ..... 137/825, 137/831–833; 222/80
See application file for complete search history.

(56) References Cited

U.S. PATENT DOCUMENTS 7,077,152 B2 * 7/2006 Karp ..... 137/833

(Continued)

FOREIGN PATENT DOCUMENTS

FR 2873171 1/2006

(Continued)

OTHER PUBLICATIONS

Xie et al. "Disposable Bio-Microfluidic Package with Passive Fluidic Control" 2005 Electronics Packaging Technology Conference. p. 93-97.

Xie et al. "Development of an Intergrated Bio-Microfluidic Package with Micro-Valves and Reservoirs for a DNA Lab on a Chip (LOC) Application." 2006 Electronic Components and Technology Conference. p. 693-698.

(Continued)

*Primary Examiner* — Kevin Lee

(74) *Attorney, Agent, or Firm* — Connolly Bove Lodge & Hutz LLP

(57) ABSTRACT

A dispenser arrangement for fluidic dispensing control into a microfluidic component comprising an enclosed fluid holding area having a base portion and a top portion and a valve adapted to be movable between an open position and a closed position and positioned at least partially in the fluid holding area. The valve comprises an elongated hollow portion having a body and two ends adapted for fluid flow from the fluid holding area to the microfluidic component in the open position, a first opening on the body of the hollow portion positioned within the fluid holding area allowing fluid communication from the fluid holding area to the microfluidic component in the open position, a sealing portion connected to a first end of the hollow portion positioned within the fluid holding area adapted for sealing connection with the top portion of the fluid holding area in the closed position and a slant second opening at a second end of the hollow portion positioned outside of the fluid holding area. The slant second opening is adapted to pierce through a sealing layer covering the microfluidic component in the open position and to insert into a first substrate housing the microfluidic component in the closed position. A dispenser unit comprising a dispenser arrangement and an actuator, wherein the actuator is a piston is also disclosed.

34 Claims, 16 Drawing Sheets

U.S. PATENT DOCUMENTS

| | | | | |
|---|---|---|---|---|
| 7,802,591 | B2 * | 9/2010 | Barrow et al. | 137/833 |
| 7,858,047 | B2 * | 12/2010 | Weng et al. | 137/833 |
| 2003/0196695 | A1 | 10/2003 | O'Connor et al. | |
| 2005/0130292 | A1 | 6/2005 | Ahn et al. | |
| 2005/0217742 | A1 | 10/2005 | Bohm | |
| 2006/0159564 | A1 | 7/2006 | Wu et al. | |
| 2006/0169339 | A1 | 8/2006 | Oh et al. | |

FOREIGN PATENT DOCUMENTS

| | | |
|---|---|---|
| WO | 03016832 | 2/2003 |
| WO | 2006018044 | 2/2006 |

OTHER PUBLICATIONS

Ahn et al. "Disposable Smart Lab on a Chip for Point-of-Care Clinical Diagnostics" Proceedings of the IEEE. vol. 92, No. 1. Jan. 2004. p. 154-173.

Oh et al. "Miniaturization of pinch-type valves and pumps for practical micro total analysis system integration" Journal of Micromechanics and Microengineering. 2005. p. 2449-2455.

International Search Report. PCT/SG2006/000276. Mailed Nov. 16, 2006.

* cited by examiner

140

| Reagents In reservoir | Required flow rate (ul/min) | Piston speed based on flow rate (mm/min) | Experimental Flowrate (ul/min) |
|---|---|---|---|
| High Salt | 50 | 0.513 | 47.24 |
| Ethanol | 50 | 0.628 | 38.27 |
| Air | 100 | 2.2 | 85.64 |
| Water | 2 | 0.0437 | 1.52 |

DISPENSER ARRANGEMENT FOR FLUIDIC DISPENSING CONTROL IN MICROFLUIDIC SYSTEM

CROSS-REFERENCE TO RELATED APPLICATIONS

This application is a National Stage Application under 35 USC §371(c) of PCT Application No. PCT/SG2006/000276, entitled "A DISPENSER ARRANGEMENT FOR FLUIDIC DISPENSING CONTROL IN MICROFLUDIC SYSTEM," filed Sep. 19, 2006, which is hereby incorporated by reference herein.

FIELD OF THE INVENTION

The present invention relates to the field of microfluidic systems, and in particular, to a dispenser arrangement for fluidic dispensing control into a microfluidic component such as channel, mixer, valve, pump, reservoir but not so limited in a microfluidic system.

BACKGROUND OF THE INVENTION

Microfluidic systems such as microfluidic devices, cartridges, packages, lab-on-a-chip (LOC) and micro total analysis system (micro-TAS) for example require fluidic dispensing control to realize particular protocol. Fluidic dispensing control includes controlling of the fluids' flow sequence, flow duration, flow direction and flow rate. A microfluidic system with multiple fluids or reagents needs to have a mechanism to control dispensing of each fluid or reagent so as to follow individual flow protocol. At the same time, the reagents' cross mixing arising to contamination in the microfluidic system should be avoided.

Some other microfluidic systems require pre-storage of reagents in integrated reservoirs. Besides storage function, these reservoirs also need dispensing mechanism, which pushes the reagents into the microfluidic system during operation. After the reagents are fully dispensed, the dispenser should close to avoid flow of other reagents into the reservoir.

Several attempts have been made to control the flow of each fluid or reagent in a microfluidic system with multiple fluids or reagents. Amongst them are different types of valves which can control the dispensing of respective fluids or reagents in a microfluidic system. One approach is described in the publication "Miniaturization of pinch type valves and pumps for practical micro total analysis system integration", Kwang W. O. et al, J. MicroMech and MicroEng. 15 (2005), pp 2449-2455. This publication discloses a miniaturized pinch-type valve which is surface mountable on microfluidic LOC devices. The pinch-type valve consists of a solenoid magnetic actuator with a pinch plunger and a biomedical grade silicone tube. According to this publication, magnetic force is used to manipulate the pinch plunger to open and close the silicone tube or channel, thereby controlling the flow of fluid.

The publication "Disposable Smart Lab on a Chip for Point-of-Care Clinical Diagnostics", Chong H. A. et al, Proceedings of the IEEE, Vol. 92, No. 1, (January 2004), pp. 154-173 discloses a micro-dispenser module in a microfluidic LOC device. A sample fluid volume is loaded into the fixed-volume metering micro-dispenser, which in turn dispenses an exact volume of liquid for further biochemical analysis. The sample fluid is introduced through a fluid inlet at a low flow rate. The fluid passes through a first passive valve and a narrow channel to enter a reservoir. A second passive valve at the end of the reservoir prevents the fluid from leaving the reservoir. As long as the applied fluid driving pressure is less than the pressure required to overcome the second passive valve, the fluid will be contained completely within the reservoir. According to this publication, applied fluid driving pressure and passive valve are used to control fluid flow within the reservoir.

The publication "Disposable Bio-microfluidic package with passive fluidic control", Ling Xie et al, Electronics Packaging Technology Conference, 7-9 Dec. 2005, discloses a disposable bio-microfluidic package using passive valves for fluidic control. The passive valve is embedded in micro-channel structures and controls the fluid flow without any actuators. The key principle of the passive valve is that the fluid flow through a main channel and surface tension causes the fluid to stop before a valve gap. The valve is closed in the initial stage. To open the valve, a threshold pressure is applied. Fluid will then pass through the valve. According to this publication, threshold pressure and passive valve are used to control fluid flow within a disposable bio-microfluidic package.

The publication "Development of an integrated Bio-microfluidic package with micro-valves and reservoirs for a DNA Lab on a Chip (LOC) Application", Ling Xie et al, Electronic Components and Technology Conference, 30 May-2 Jun. , 2006, discloses a bio-microfluidic package with integrated reservoir and valves for LOC application. A passive valve is embedded in a channel and the valve is activated by pressure. At storing condition, the valve is closed to prevent reagent flowing from a reservoir to the channel. Once fluidic pressure in the reservoir increases and reaches the threshold pressure, the valve opens. The valve is passive and therefore controls the fluid flow without any moving parts. According to this publication, threshold pressure and passive valve are also used to control fluid flow within a disposable bio-microfluidic package.

U.S. patent application Ser. No. 11/096,035 discloses microfluidic circuits including triggerable passive valves, connected in series or in parallel. A triggerable passive valve arrangement includes a flow restrictor, a pressurizing device, and a passive valve, connected with a fluid delivery channel. The triggerable passive valve acts upon a sample liquid. As the sample liquid flows into the fluid delivery channel, it stops at the passive valve. For flow to occur beyond the passive valve, the pressure of the sample liquid must exceed the burst pressure of the passive valve. The burst pressure of the passive valve is determined by its geometry and physical properties. The pressurizing device exerts pressure on the sample liquid when activated, increasing its pressure to a value higher than the burst pressure of the passive valve, causing the sample liquid to move past the passive valve. Most of the sample liquid flows in the direction of the passive valve, rather than in the direction of the flow restrictor. This is because the flow restrictor has a higher resistance to flow once the passive valve has been breached. Once flow beyond the passive valve occurs, the pressure exerted upon the sample liquid by the pressurizing device can be removed. According to U.S. patent application Ser. No. 11/096,035, applied fluid driving pressure and passive valve are used to control fluid flow.

U.S. patent application Ser. No. 09/985943 discloses microfluidic flow control devices. Each microfluidic flow control device includes a regulating device having two overlapping channel segments separated by a deformable membrane in fluid communication with one another. The deformable membrane is responsive to changes in pressure between two channel segments. When the pressures in the channel segments are substantially the same, the deformable membrane adopts a neutral position. If the pressure in either channel segment is increased, then the deformable membrane will deform towards the other channel segment. According to U.S. patent application Ser. No. 09/985,943, the regulating device uses pressure to control the direction of deformation of the membrane, thereby controlling the flow of fluid.

Controlling the dispensing of fluid and fluid flow rate in prior art devices to prevent back flow and cross mixing of fluids is difficult. It is also tough to maintain a low dead volume in the prior art devices. These difficulties in controlling the dispensing of fluid may lead to contamination of different fluids in microfluidic systems. Therefore, an objective of the present invention is to provide an alternative dispenser arrangement that can control dispensing of fluid and fluid flow rate in microfluidic systems, thereby advantageously avoids or reduces some of the above-mentioned drawbacks of prior art devices.

SUMMARY OF THE INVENTION

Accordingly, the invention provides a dispenser arrangement for fluidic dispensing control into a microfluidic component comprising an enclosed fluid holding area and a valve adapted to be movable between an open position and a closed position and positioned at least partially in the fluid holding area. The valve comprises an elongated hollow portion having a body and two ends adapted for fluid flow from the fluid holding area to the microfluidic component in the open position, wherein the first end of the hollow portion is sealed such that it prevents fluid from entering the first end and wherein the first end is positioned within the fluid holding area. The valve further comprises a first opening on the body of the hollow portion positioned within the fluid holding area allowing fluid communication from the fluid holding area to the microfluidic component in the open position and a slant second opening at the second end of the hollow portion positioned outside of the fluid holding area. The slant second opening is adapted to pierce through a sealing layer covering the microfluidic component in the open position and to insert into a first substrate housing the microfluidic component in the closed position. Some examples of microfluidic components include channels, mixers, valves, pumps, reservoirs but are not so limited. The channels can have any suitable cross-sections and shapes, for example, circular, rectangle and triangle. Some examples of fluid holding areas include chambers and reservoirs but are not limited thereto.

In one embodiment of the invention, the valve is movable between a first closed position where the valve is not in contact with the microfluidic component and a second closed position. In the second closed position, the valve is in sealing connection with the microfluidic component when a force is exerted on the first end of the hollow portion.

In another embodiment of the invention, the open position is an intermediate position between the first closed position and the second closed position. In the open position, the slant second opening of the valve engages the microfluidic component, thereby allowing fluid communication from the fluid holding area to the microfluidic component. Also in the open position, the fluid communication allows fluid in the fluid holding area to flow in from the first opening and to flow out from the slant second opening into the microfluidic component.

In a further embodiment of the invention, the first substrate comprises a deformable material such as an elastomer material but is not so limited. Some examples of elastomer material comprise polydimethylsiloxane (PDMS) and rubber but are not so limited. The first substrate can also comprises a rigid material selected from the group consisting of cyclic olefin copolymer (COC), polycarbonate (PC), ceramic, glass, silicon, thermoplastic and Flame Resistant 4 (FR4) material but are not so limited.

In another embodiment of the invention, the enclosed fluid holding area is formed within a second substrate. The second substrate comprises a deformable material such as an elastomer material but is not so limited. Some examples of elastomer material comprise polydimethylsiloxane and rubber but are not so limited.

The second substrate can also comprise a rigid material selected from the group consisting of COC, PC, ceramic, glass, silicon, thermoplastic and FR4 material but are not so limited.

In another embodiment of the invention, the first substrate and the second substrate are adapted to be bonded by bonding means. The bonding means can comprise a double sided tape, glue, clipping means or the substrates are adapted to be bonded by pressure means, temperature means, ultrasonic means, thermosonic means, thermocompression means, laser welding means, transfer molding means, overmolding or injection molding. The bonding means can also be biocompatible.

In another embodiment of the invention, the enclosed fluid holding area is covered by a covering layer. The covering layer may comprise a deformable material such as elastomer but is not so limited. Some examples of elastomer material comprise polydimethylsiloxane and rubber but are not so limited. The covering layer can also comprise a rigid material selected from the group consisting of COC, PC, ceramic, glass, silicon and FR4 material but are not so limited.

In another embodiment of the invention, the covering layer is situated above the hollow portion and comprises a reinforced portion arranged such that it is in contact with the first end of the hollow portion when a force is exerted on the covering layer. The reinforced portion can be of the same material as the covering layer but may be thicker in dimensions. Alternatively, the reinforced portion can comprise a different material from the covering layer, usually the material for the reinforced portion is thicker in dimension or has a higher tensile strength and therefore is mechanically more resistant to stress. The reinforced portion prevents the covering layer from tearing when a force is exerted onto the covering layer towards the valve. Some examples of materials for the reinforced portion could be polymethyl methacrylate (PMMA), COC or PC but are not so limited.

In another embodiment of the invention, the enclosed fluid holding area comprises a base portion and a top portion. The top portion of the enclosed fluid holding area is proximal to the microfluidic component. The base portion of the enclosed fluid holding area is distal from the microfluidic channel component.

In another embodiment of the invention, the valve is sealed by three levels of sealing in the second closed position. Firstly, the sealing of the first end of the hollow portion is provided by a sealing portion connected to a first end of the hollow portion positioned within the fluid holding area. Secondly, the first opening on the body of the hollow portion is sealed by the first substrate in the second closed position. Thirdly, the slant second opening at the second end of the hollow portion is sealed by the first substrate in the second closed position.

In another embodiment of the invention, when viewed from the top, the fluid holding area has an essentially circular cross-sectional shape or a polygonal cross-sectional shape. The essentially circular shape can be a circular shape or an elliptical shape. The polygonal shape may be an essentially triangular shape, trapezoidal shape, rectangular shape (including a square shape), pentagonal shape, hexagonal shape, or octagonal shape. From the side-view, the fluid holding area typically has a polygonal cross-sectional shape. The polygonal shape may be an essentially trapezoidal shape, square shape, rectangular shape, pentagonal shape, hexagonal shape, or octagonal shape. The fluid holding can however also have geometrically irregular shapes. In several embodiments, the base portion of the fluid holding area has a wider cross-section area than the top portion. The fluid holding area can also be a truncated cone for example.

In another embodiment of the invention, the microfluidic component is adapted to accommodate the body of the hollow portion at an engagement region. In this embodiment, the slant second opening of the valve may engage the microfluidic component in the open position. Usually, the engagement region has a dimension larger than the body of the hollow portion of the valve.

In another embodiment of the invention, the force that is used to actuate the valve is provided by an actuator. The actuator can comprise a piston, an integrated micropump, or the actuation may be achieved by electrostatic means, pneumatic means, hydraulic means, electrical means, chemical means, magnetic means, thermal means, optical means or physical means. Accordingly, the present invention also provides for a dispenser unit comprising a dispenser arrangement and an actuator. The actuator may be a piston, an integrated micropump or as the actuation may be achieved by electrostatic, pneumatic means, hydraulic means, electrical means, magnetic means, chemical means, thermal means, optical means or any other physical means.

In an embodiment of the dispenser unit, the actuator is a cylinder having two ends. The cross-sectional area of each end of the cylinder can approximately be the same or smaller than the cross-sectional area of the top portion of the enclosed fluid holding area.

The following figures illustrate various exemplary embodiments of the present invention. However, it should be noted that the present invention is not limited to the exemplary embodiments illustrated in the following figures.

DETAILED DESCRIPTION OF THE INVENTION

Exemplary embodiments of a dispenser arrangement for fluidic dispensing control into a microfluidic component such as a channel are described in detail below with reference to the accompanying figures. In addition, the exemplary embodiments described below can be modified in various aspects without changing the essence of the invention.

Figure 1A:
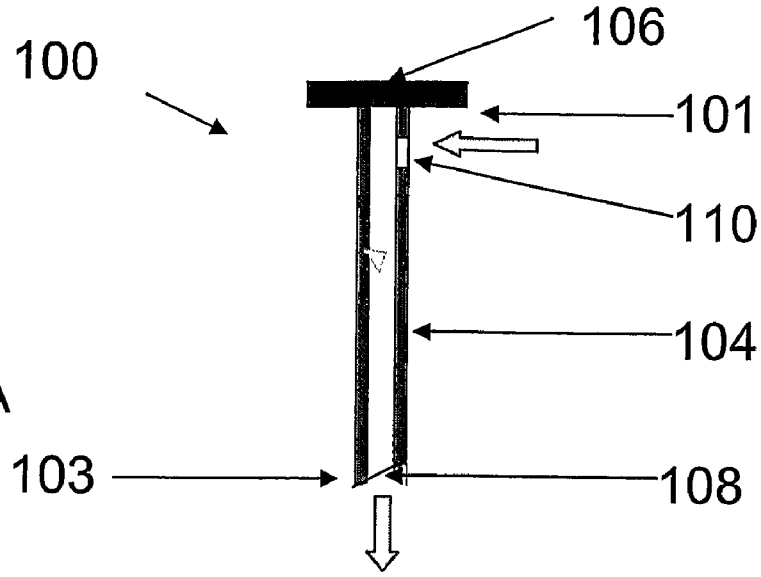
FIG. 1A shows a cross-sectional view of a valve according to an embodiment of the present invention.

FIG. 1A shows a cross-sectional view of a valve according to an embodiment of the present invention. The valve has been referred to as the pin valve for illustrative purposes. The pin valve 100 comprises an elongated hollow portion or shaft 104 having a body and two ends 101, 103. A sealing portion or sealing cap 106 is positioned at an end 101 of the hollow portion 104 and the other end 103 of the hollow portion 104 is an opening with a slant tip 108. Another opening 110 is present on the body of the hollow portion 104, nearer to the sealing cap 106, but not limited to this position. The position of the opening 110 on the body of the hollow portion 104 may depend on the level of fluid or reagent in a fluid holding area where the pin valve 100 is housed. The opening 110 on the body of the hollow portion 104 may be termed the inlet hole as it allows for fluid to enter the pin valve 100, while the opening with the slant tip 108 at the end of the hollow portion 104 may be termed the exit hole as it allows for fluid to exit the pin valve 100. The direction of fluid flow is as indicated by the short arrows in FIG. 1A. Some suitable materials for the sealing cap 106 comprise elastomers such as PDMS and rubber, plastic, metal, wood and glass but are not so limited. Some suitable materials for the hollow portion 104 comprise plastic, thermoplastic and metal but are not so limited. It would be preferred if the material for the hollow portion 104 is of a biocompatible nature.

Figure 1B:
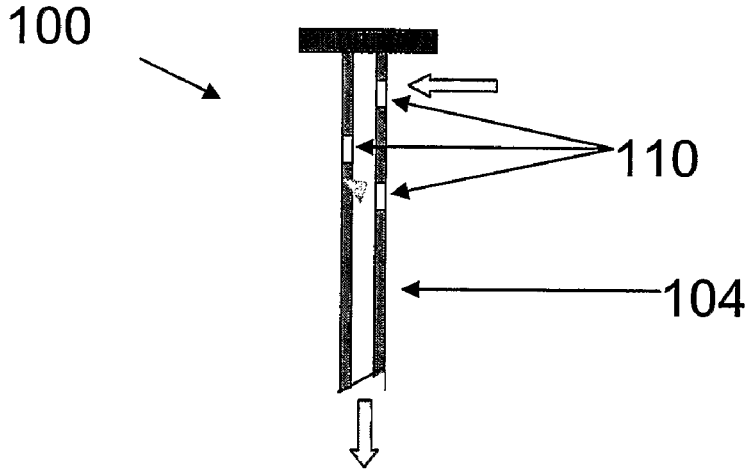
FIG. 1B shows a cross-sectional view of a valve having a plurality of openings on the body of the hollow portion according to another embodiment of the present invention.

FIG. 1B shows a cross-sectional view of a valve having a plurality of openings on the body of the hollow portion according to another embodiment of the present invention. One or a plurality of openings 110 can be present on the body of the hollow portion 104 of the valve 100. These openings 110 can be at any suitable position on the body of the hollow portion 104. A plurality of openings 110 may be useful if a higher flow rate is desired. In addition, if any of the openings 110 is clogged, fluid can flow in from any of the other available openings 110. Having a valve 100 with a plurality of openings will also render the valve 100 more suitable for different fluid levels within the fluid holding area.

Figure 1C:
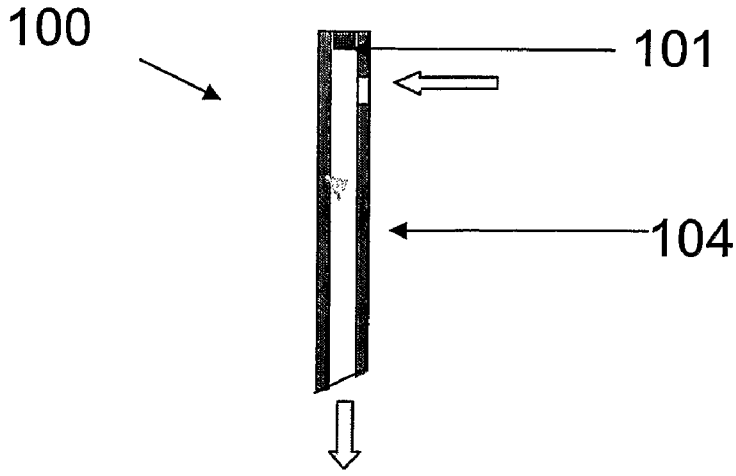
FIG. 1C shows a cross-sectional view of a valve with no sealing portion according to another embodiment of the present invention.

FIG. 1C shows a cross-sectional view of a valve with no sealing portion according to another embodiment of the present invention. Instead of having an additional sealing portion or cap as in FIG. 1A, the end 101 of the hollow portion 104 can be sealed to prevent any fluid from entering the valve 100. The sealed end 101 may be an integral part of the hollow portion 104 or the end 101 can be sealed by glue, epoxy or silicone. The end 101 can also be sealed by insertion of a small piece of sealing material or by fabricating a hollow portion 104 sealed at the end 101.

Figure 2A:
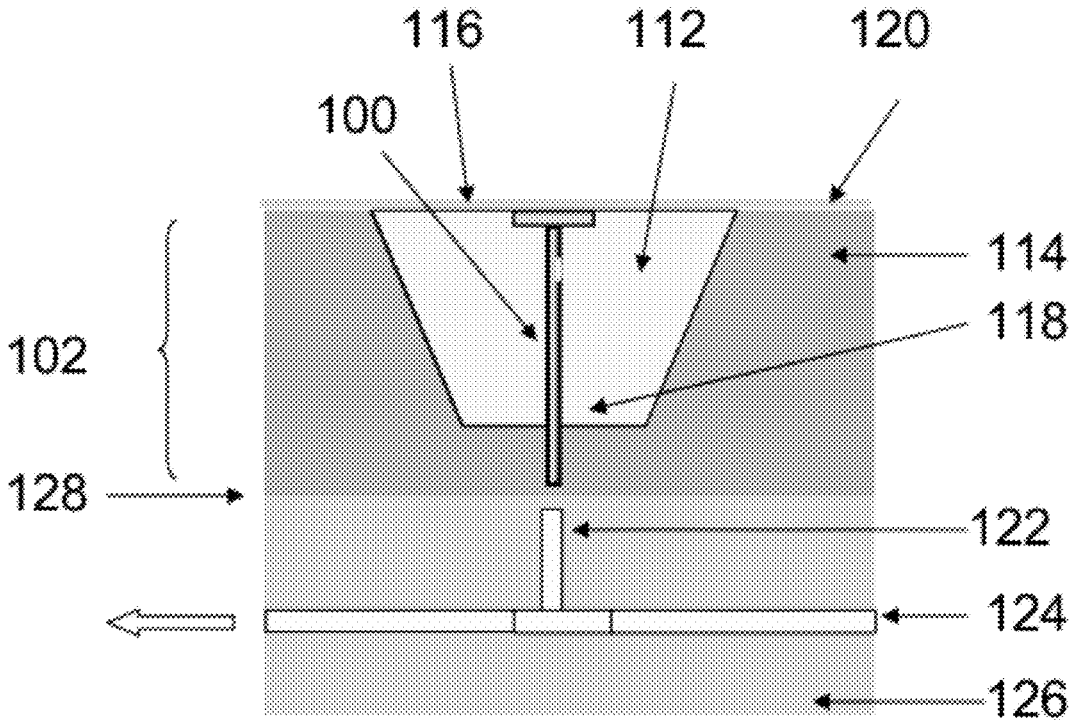
FIG. 2A shows a cross-sectional view of a dispenser arrangement according to an embodiment of the present invention when the valve is in a starting closed position where the valve is not in contact with the microfluidic channel.

FIG. 2A to FIG. 2D shows cross-sectional views of the dispenser arrangement during different stages of dispensing fluid into a microfluidic channel. FIG. 2A shows a cross-sectional view of a dispenser arrangement according to an embodiment of the present invention when no fluid is dispensed. In FIG. 2A, the pin valve 100 of the dispenser arrangement 102 is in a starting closed position and the pin valve 100 is not in contact with a microfluidic channel 124. No fluid is able to be dispensed into the microfluidic channel 124 in FIG. 2A.

The dispenser arrangement 102 comprises of a fluid holding area or reservoir 112 and the pin valve 100 which is integrated or partially positioned within the fluid holding area 112. The fluid holding area 112 can be formed within a substrate 114 or it can be a preformed holding area. The fluid holding area 112 has a base portion 116 and a top portion 118. The base portion 116 of the fluid holding area 112 may be covered or sealed with a thin covering layer 120 after fluid has been pre-stored in the fluid holding area 112 so as to seal the fluid holding area 112 to prevent any contamination. The substrate 114 housing the fluid holding area 112 may be formed from any suitable materials including, but not limited to polymers such as elastomers, COC, PC, ceramic, glass, silicon, plastic and FR4 material. The covering layer 120 may be formed from any suitable materials including, but not limited to polymers, elastomers, plastic, metal, wood, glass, COC, PC, ceramic, silicon and FR4 material.

The dispenser arrangement 102 comprising the fluid holding area 112 and the pin valve 100 is positioned to be aligned to an inlet 122 of a microfluidic channel 124 formed on another substrate 126. A part of the pin valve 100 is positioned within the fluid holding area 112 and another part of the pin valve 100 is positioned outside of the fluid holding area 112 for connection to the inlet 122 of the microfluidic channel 124 on the other substrate 126. The fluid holding area 112 and the pin valve 100 are aligned along the same longitudinal axis as the inlet 122 of the microfluidic channel 124. Each inlet 122 of the microfluidic channel 124 is connected to a dispenser arrangement 102 and there may be a plurality of inlets of the microfluidic channel if there is a plurality of dispenser arrangements. The substrate 126 housing the microfluidic channel 124 can be of the same materials as the substrate 114 housing the fluid holding area 112 and the pin valve 100. Both the substrates 114, 126 can be bonded together by a double sided biocompatible tape 128. The substrates 114, 126 can also be glued together or bonded by some form of clips. The substrates 114, 126 may also be adapted to be bonded by pressure means, temperature means, ultrasonic means, thermosonic means, thermocompression means, laser welding means, transfer molding means, overmolding or injection molding but are not so limited In FIG. 2B, an external actuator 130 is brought in close contact with the covering layer 120 covering the fluid holding area 112. The covering layer 120 deforms upon exertion of a downward force or pressure by the external actuator 130. Upon the deformation of the covering layer 120, the pin valve 100 is activated or lowered towards the microfluidic channel 124 into an intermediate open position. The slant tip 108 of the pin valve 100 penetrates through a thin sealing layer 132 covering the microfluidic channel 124 without clogging the slant tip opening 108. Then fluid flows from the fluid holding area 112 to the microfluidic channel 124 in the open position. The direction of fluid flow is as indicated by the short arrows in FIG. 2B. The pin valve 100 functions as an on-off valve during the course of deformation of the covering layer 120 and allows for fluid communication from the fluid holding area 112 to the microfluidic channel 124 after the deformation of the covering layer 120 as shown by the arrows. The force exerted by the external actuator 130 is preferably along the longitudinal axis of the pin valve 100 and the external actuator 130 can be a piston or any suitable objects as long as it allows for an exertion of a force. The actuator may also be an integrated micropump, or the actuation may be achieved by electrostatic means, pneumatic means, hydraulic means, electrical means, thermal means, optical means or physical means.

Figure 2B:
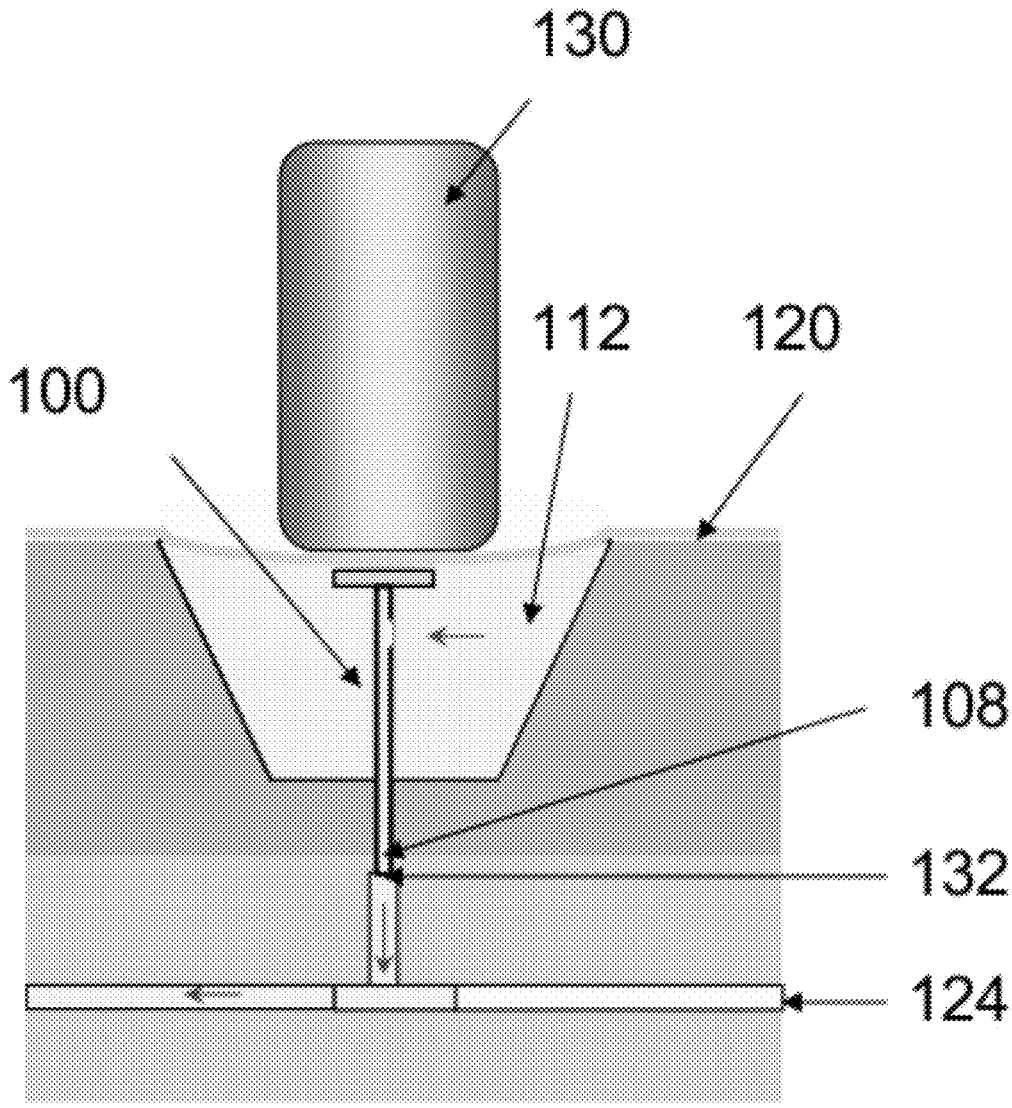
FIG. 2B shows a cross-sectional view of a dispenser arrangement according to an embodiment of the present invention when the valve is partially depressed into an intermediate open position where the valve engages the microfluidic channel.
Figure 2C:
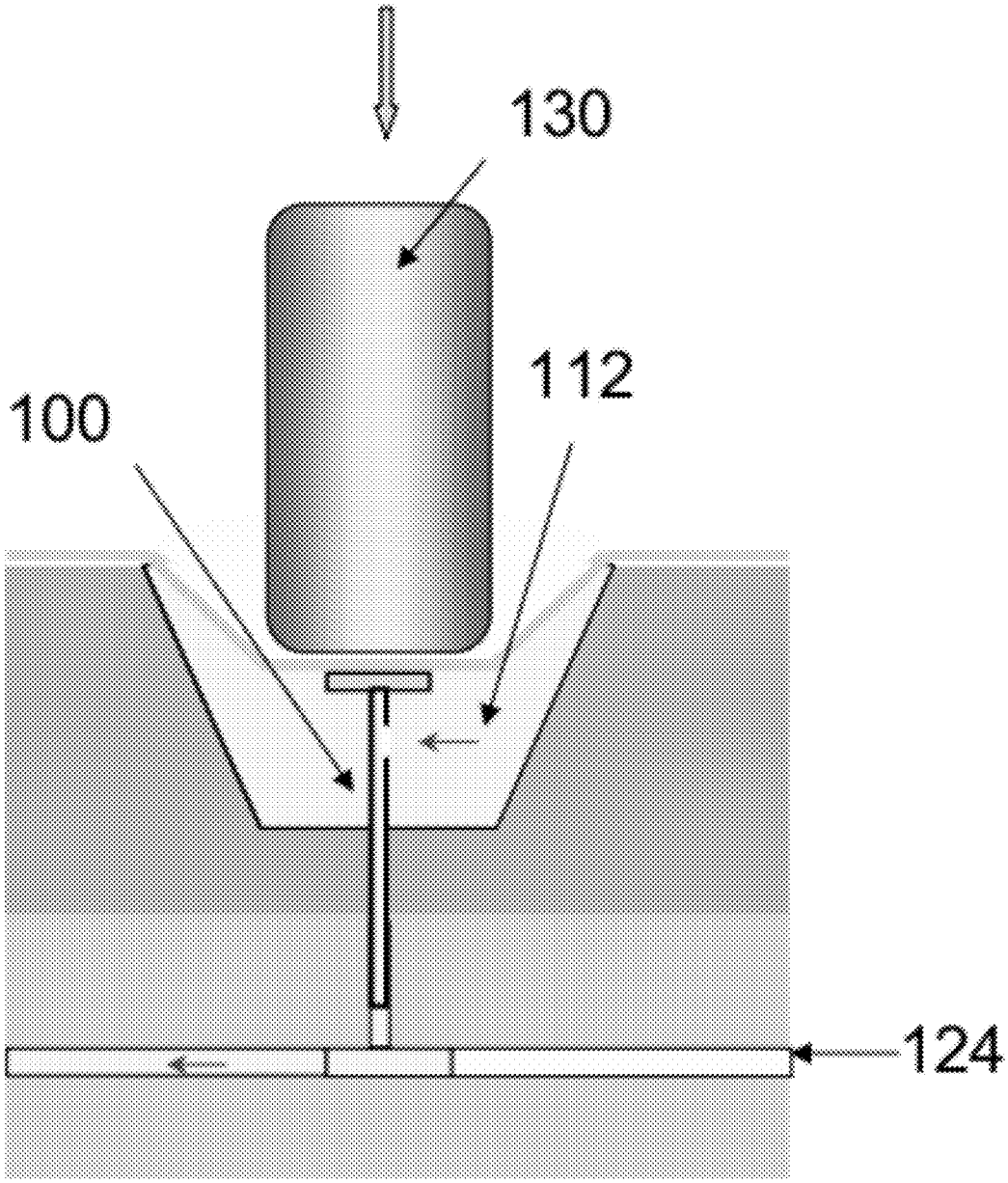
FIG. 2C shows a cross-sectional view of a dispenser arrangement according to an embodiment of the present invention when the valve is further depressed at a constant rate to allow for dispensing of fluid into the microfluidic channel.

In FIG. 2C, a constant force is applied onto the external actuator 130 and preferably along the same longitudinal axis as the pin valve 100. The rate of dispensing of the fluid from the fluid holding area 112 into the microfluidic channel 124 is controlled by the displacement speed of the external actuator 130. The direction of fluid flow is as indicated by the short arrows in FIG. 2C.

Figure 2D:
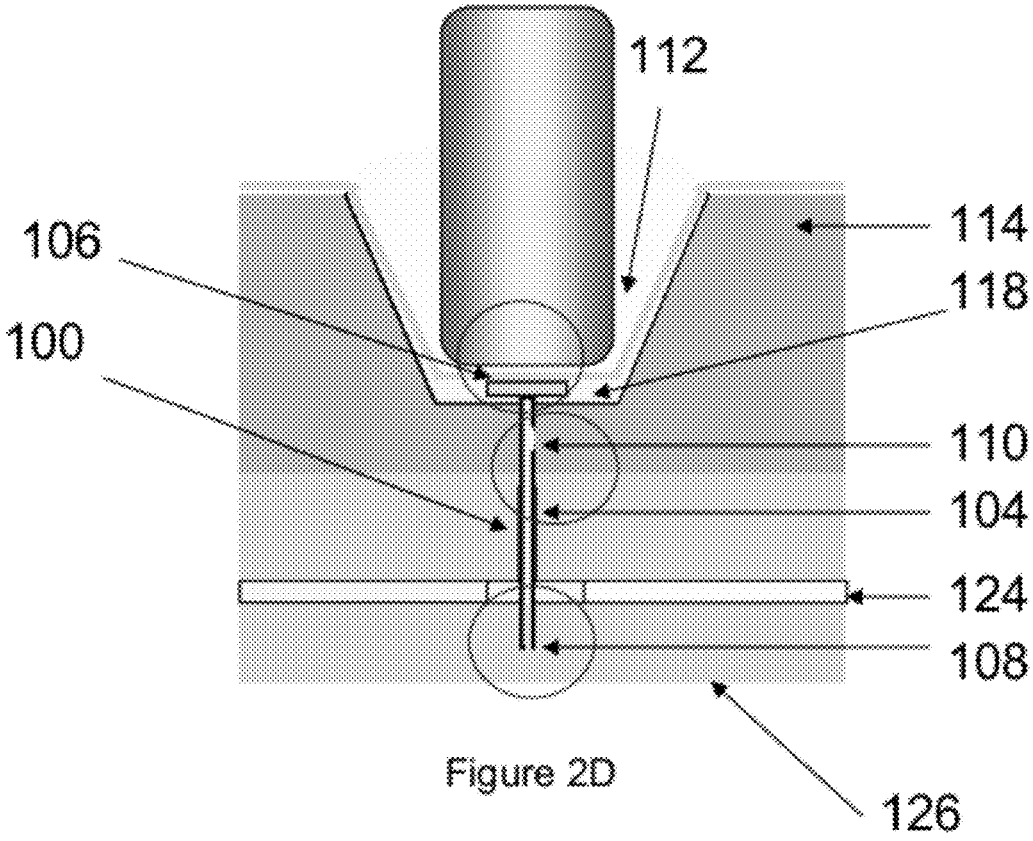
FIG. 2D shows a cross-sectional view of a dispenser arrangement according to an embodiment of the present invention when the valve is fully depressed into an ending closed position where the valve is sealed.

In FIG. 2D, the pin valve 100 is lowered until the sealing portion 106 of the pin valve 100 is in contact with the top portion 118 of the fluid holding area 112 or in an ending closed position. When the pin valve 100 is in the ending closed position, the pin valve 100 is closed by three levels of sealing as circled in FIG. 2D. The first level of level is by the sealing portion 106 with the top portion 118 of the fluid holding area 112. The sealing portion 106 serves to prevent fluid from flowing out of the fluid holding area 112 at the end of dispensing and thus prevent other reagents in the microfluidic channel 124 from flowing into the fluid holding area 112. The second level of sealing is where the opening 110 on the body of the hollow portion 104 is blocked by the substrate material 114 housing the fluid holding area 112 and the pin valve 100. The third level of sealing is where the slant tip opening 108 is clogged by the substrate material 126 housing the microfluidic channel 124 and forms an air tight seal preventing any remaining fluid within the pin valve 100 from escaping and preventing any external fluid in the microfluidic channel 124 from coming in contact with the fluid housed within the pin valve 100. Therefore, the three levels of sealing will prevent backflow of fluid from within the pin valve 100 or the fluid holding area 112 and also prevent any fluid from within the microfluidic channel 124 to be in contact with the fluid in the pin valve 100 or the fluid holding area 112. The levels of sealing will also prevent any cross mixing of fluids between the fluid in the pin valve 100 or fluid holding area 112 and the fluid in the microfluidic channel 124. This also helps the fluids from subsequent fluid holding areas to flow into the output side of the microfluidic system.

Figure 3:
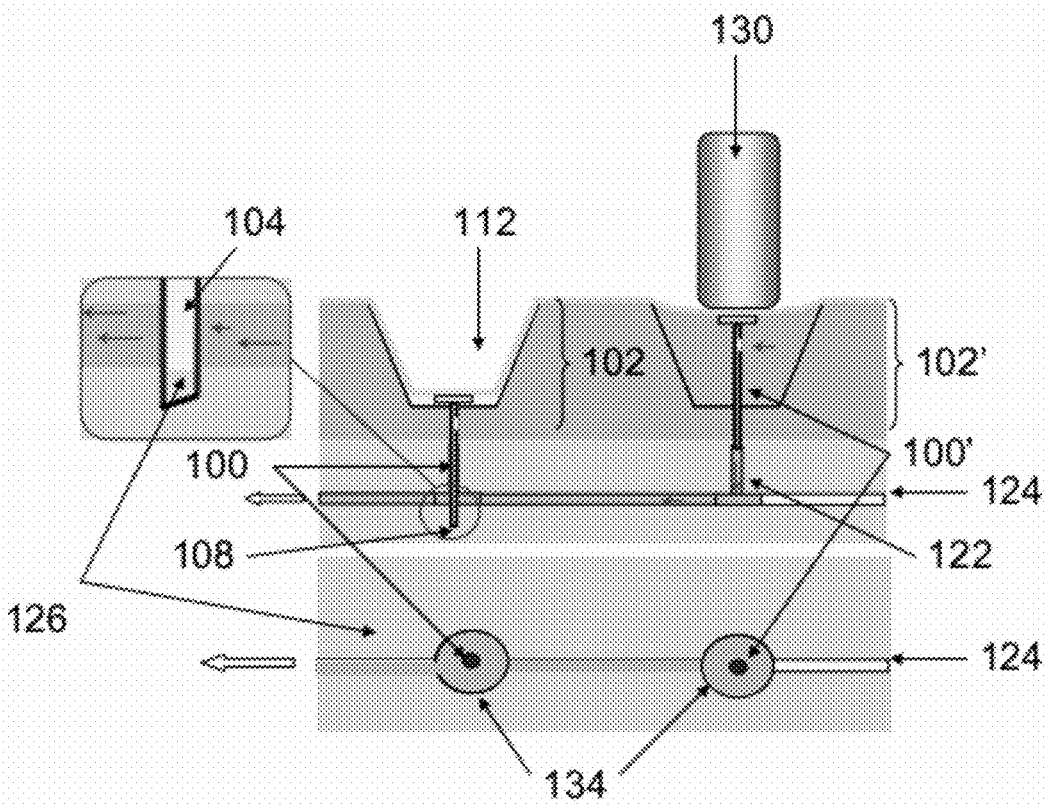
FIG. 3 shows top and cross-sectional views of two dispenser arrangements connected sequentially according to an embodiment of the present invention where a valve of a first dispenser arrangement is fully depressed into an ending closed position where the valve is sealed and a valve of a second dispenser arrangement is in an intermediate open position where the valve engages the microfluidic channel.

A plurality of dispenser arrangements may be connected sequentially or in parallel depending on requirements of the microfluidic device. The number of dispenser arrangements may correspond to the required number of reagents or fluids within the microfluidic device. FIG. 3 shows top and cross-sectional views of two dispenser arrangements 102, 102' connected sequentially according to an embodiment of the present invention. In this embodiment, a pin valve 100 of a first dispenser arrangement 102 is fully depressed into an ending closed position where the pin valve 100 is sealed and a pin valve 100' of a second dispenser arrangement 102' is in an intermediate open position where the pin valve 100' engages the inlet 122 of the microfluidic channel 124. Depending on the reagent housed in the respective fluid holding area and on the requirement of the dispensing sequence of the reagent in the specific protocol, the pin valve 100 of the first dispenser arrangement 102 housing the first desired reagent in the fluid holding area 112 is fully depressed into an ending closed position where the pin valve 100 is sealed. Then the pin valve 100' of the second dispenser arrangement 102' is activated by moving the actuator 130 over the pin valve 100' of the second dispenser arrangement 102'. This process can be repeated for any required number of dispenser arrangements and in the order as desired. There is a common microfluidic channel 124 linking both the dispenser arrangements 102, 102'. The enlarged portion of the first dispenser 102 shows that any remaining fluid that is not dispensed into the microfluidic channel 124 is sealed within the hollow portion 104 of the pin valve 100 by the substrate material 126 housing the microfluidic channel 124 when the pin valve 100 is fully depressed into an ending closed position. In addition, no fluid in the channel is allowed into the hollow portion 104 of the pin valve 100.

Dead volume is the volume of any reagent or system flow passage, where a dead-end passageway or cavity could retain reagents to contaminate subsequent reagents or flow media. This value can be influenced by many parameters, as many factors come into play to determine the actual dead volume, such as miscibility, viscosity, or binding energy. The quantity of the former reagent that remains inside the microfluidic channel after flushing with some specified volume is defined as dead volume. To eliminate dead volume in the common microfluidic channel 124, the microfluidic channel 124 is adapted to accommodate the body of the hollow portion 104 of the pin valve 100 at an engagement region 134 where the slant second opening 108 of the pin valve 100 engages the microfluidic channel 124 in the open position as shown in FIG. 3. The engagement region 134 has a dimension larger than the body of the hollow portion 104 and is typically of an essentially circular shape but may also adopt other suitable shapes, including, but not limited to square shape, triangular shape to accommodate the dimensions and shape of the pin valve 100.

The flow within any microfluidic channel of flow obeys the equation of continuity:

$$Rv=A*v=\text{a constant}=> \qquad \text{equation (1)}$$

Where Rv is the volume flow rate

A is the cross-sectional area of the microfluidic channel of flow at any point v is the speed of the fluid at that point, assumed to be constant across A The cross-sectional area of the microfluidic channel of flow is defined as follows:

$$A=\pi*r*r=> \qquad \text{equation (2)}$$

Where r is the Radius of the Microfluidic Channel

From equations (1) and (2) above, the radius of the microfluidic channel will affect the volume flow rate of fluid. For a constant volume flow rate, if the microfluidic channel becomes narrow, the flow speed increases. If the microfluidic channel becomes larger, the flow speed decreases. Therefore, an appropriate dimension of the common microfluidic channel size in the present invention is in the range of 1 μm to 5000 μtm. Other suitable formulas may also apply if the cross-section of the channel is not a circular cross-section. It is within the ability of an average man skilled in the art to determine the respective flow rates for the other appropriate channel cross-sections.

For the present invention, the slant tip of the pin valve is typically substantially sharp enough to penetrate through the thin sealing layer covering the microfluidic channel as shown in FIG. 2B while not so sharp as to allow clogging of the substrate housing the microfluidic channel as shown in FIG. 2D. The slant tip of the pin valve may typically be in the range of about 0° to about 70° , for example 15° to 45°, 20° to 35°, but not limited thereto. When the tip of the pin valve is too flat, for example about 0°, the tip will not be able to penetrate through the sealing layer covering the microfluidic channel, thereby clogging the opening of the pin valve and blocking the fluid flow path. When the tip of the pin valve is too sharp, for example higher than 70°, like those used in a syringe, the sharp tip will push the substrate housing the microfluidic channel aside and there will be no clogging of the opening of the pin valve. A slant tip of about 25° will be advantageous in one embodiment as it will allow penetrating through the sealing layer covering the microfluidic channel without clogging the opening of the pin valve in FIG. 2B and then clog the opening and form an air tight seal when fully lowered into the substrate housing the microfluidic channel in FIG. 2D.

Figure 4:
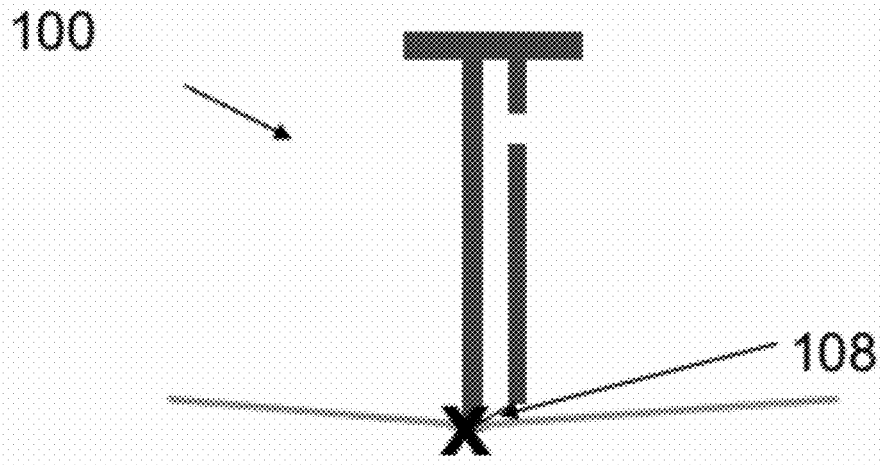
FIG. 4 shows a magnified cross-sectional view of a valve of a dispenser arrangement according to an embodiment of the present invention when the valve is depressed into an intermediate open position where the valve just engages the microfluidic channel as shown in FIG. 2B.

FIG. 4 shows a magnified cross-sectional view of a pin valve of a dispenser arrangement according to an embodiment of the present invention when the pin valve is depressed into an intermediate open position where the pin valve just engages the microfluidic channel as earlier shown in FIG. 2B. The slant tip opening 108 of the pin valve 100 is substantially sharp enough to penetrate through a thin layer, similar to the thin sealing layer covering the microfluidic channel.

Figure 5:
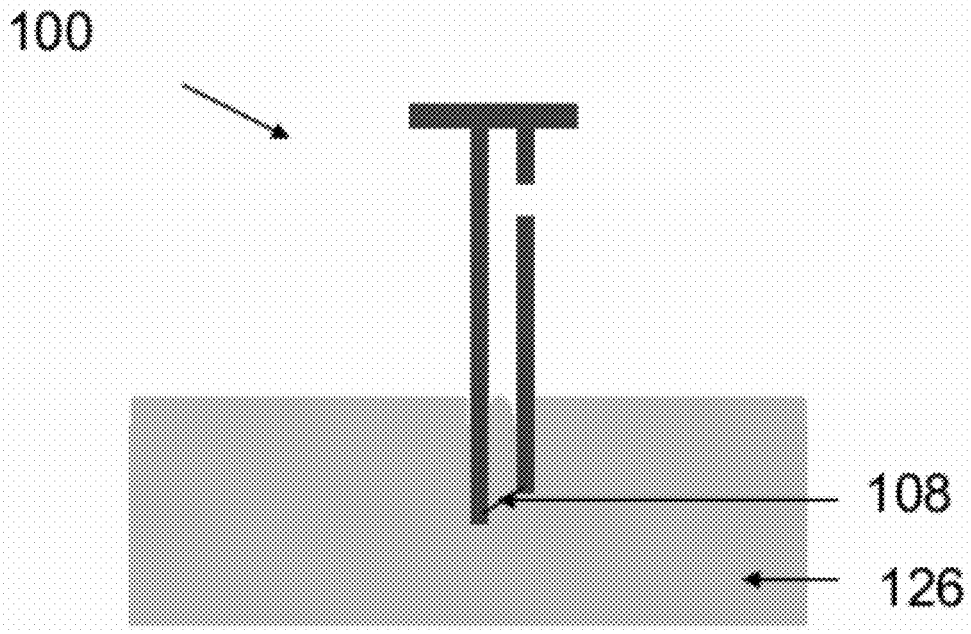
FIG. 5 shows a magnified cross-sectional view of a valve of a dispenser arrangement according to an embodiment of the present invention when the valve is fully depressed into an ending closed position where the valve is sealed as shown in FIG. 2D.

FIG. 5 shows a magnified cross-sectional view of a pin valve of a dispenser arrangement according to an embodiment of the present invention when the pin valve is fully depressed into an ending closed position where the pin valve is sealed as earlier shown in FIG. 2D. The slant tip opening 108 of the pin valve 100 is clogged by the substrate material 126 housing the microfluidic channel and forms an air tight seal to prevent fluid from entering or escaping from the pin valve 100.

Figure 6:
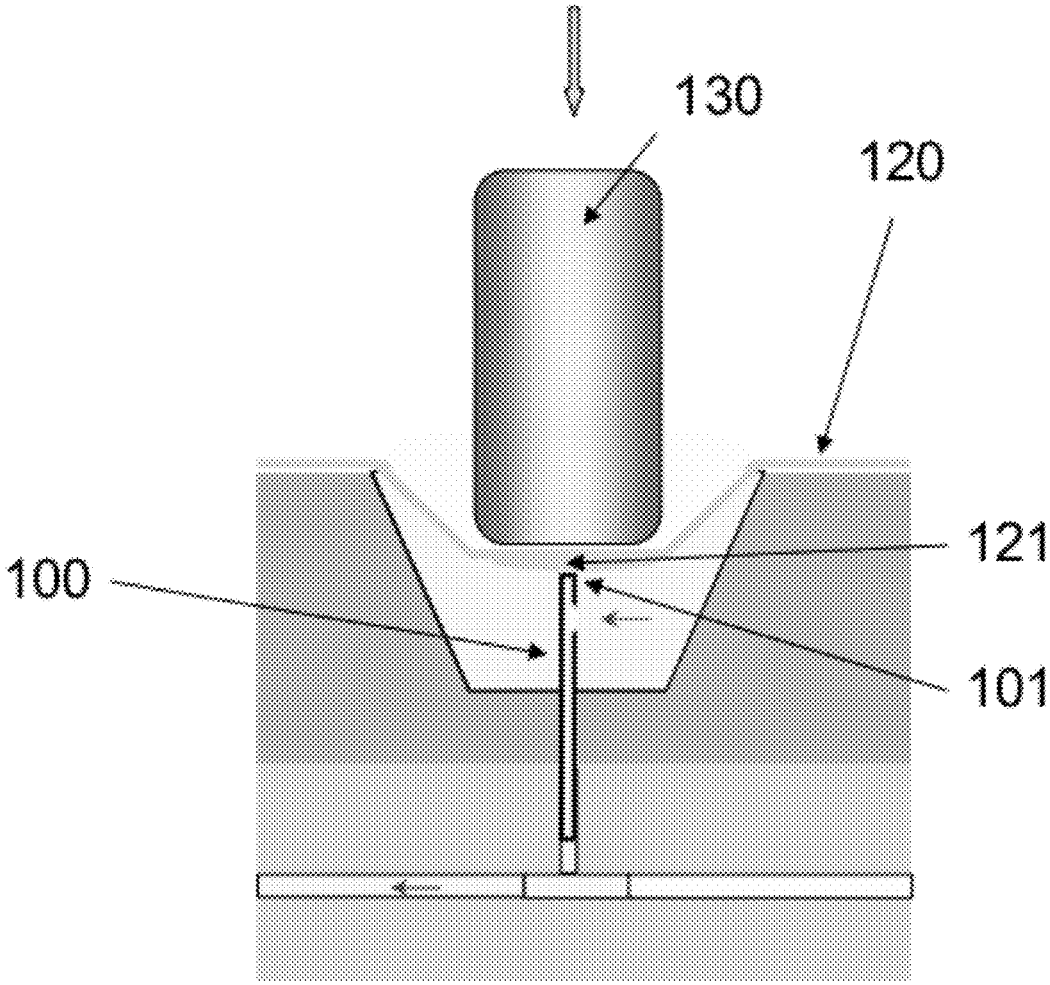
FIG. 6 shows a cross-sectional view of a dispenser arrangement according to an embodiment of the present invention showing a valve with no sealing portion and a covering layer with an reinforced portion.

FIG. 6 shows a cross-sectional view of a dispenser arrangement according to an embodiment of the present invention showing a valve with no sealing portion and a covering layer with a reinforced portion. For a valve 100 with no sealing portion, the covering layer 120 may comprise a reinforced portion 121 such that the covering layer 120 does not tear when a force is exerted on the covering layer 120 towards the valve 100. The surface area of the reinforced portion 121 may be larger in dimensions when compared to the dimensions of the end 101 of the valve 100 to allow for a bigger contact area with the actuator 130. The reinforced portion 121 may be of the same material as the covering layer 120 but may be thicker in dimensions. Alternatively, the reinforced portion 121 may comprises a different material from the covering layer 120, such that the reinforced portion 121 is more resistant to pressure change.

The fluid holding area may be of different shapes, depending on requirements. From the top view, the fluid holding area may have an essentially circular shape such as a circular, semicircular, or an elliptical shape, but is not so limited. Alternatively, from the top view, the fluid holding area may have a polygonal shape such as a triangular shape, a trapezoidal shape, a square shape, a rectangular shape, a pentagonal shape, a hexagonal shape, or an octagonal shape, but is not so limited. From the cross-sectional view, the fluid holding area can be of a polygonal shape such as a triangular shape, a square shape, a rectangular shape, a trapezoidal shape, a pentagonal shape, a hexagonal shape, or an octagonal shape, but is not so limited.

Figure 7A:
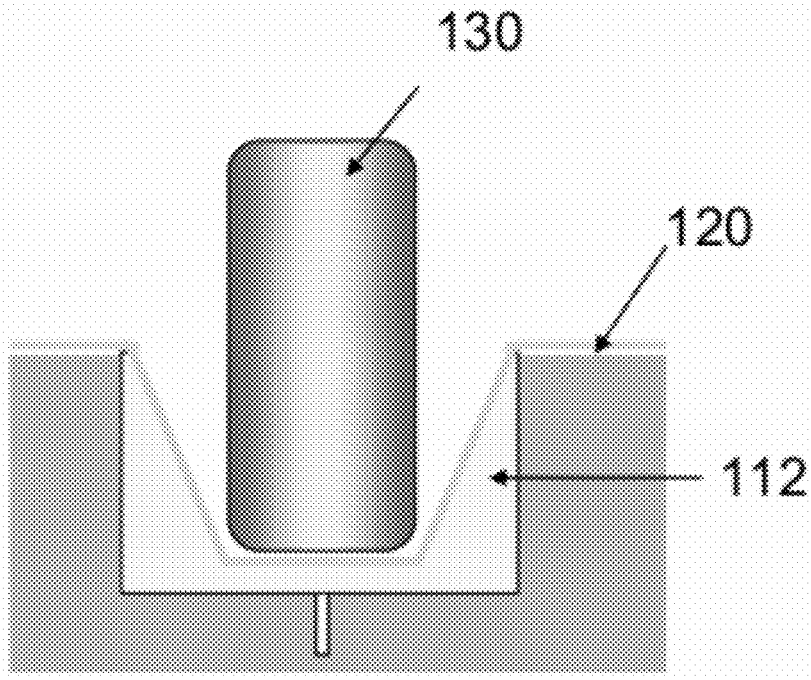
FIG. 7A shows a cross-sectional view of a dispenser arrangement according to an embodiment of the present invention showing a cylindrical fluid holding area with a small cylindrical actuator.

FIG. 7A shows a cross-sectional view of a dispenser arrangement according to an embodiment of the present invention showing a cylindrical fluid holding area 112 with a small cylindrical actuator 130. The fluid holding area 112 has a rectangular cross-sectional view and a circular top view, thereby forming a cylinder. The dimensions of the cylindrical actuator 130 are much smaller when compared to that of the cylindrical fluid holding area 112. For a cylindrical fluid holding area 112 with a small cylindrical actuator 130, there is a large dead volume. This can be a result of the actuator 130 not being optimized to push all the fluid out of the fluid holding area 112 as there can be some portions that may not be reached by the effect of the actuator 130 acting on the covering layer 120 covering the fluid holding area 112. The outline shows the deformation of the covering layer 120 when the actuator 130 is being exerted downwards on the covering layer 120.

Figure 7B:
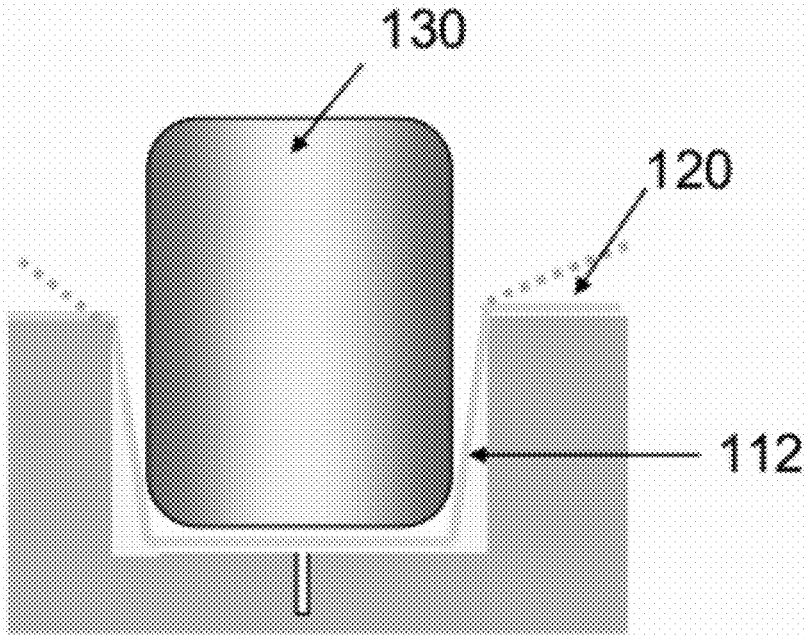
FIG. 7B shows a cross-sectional view of a dispenser arrangement according to an embodiment of the present invention showing a cylindrical fluid holding area with a big cylindrical actuator.

FIG. 7B shows a cross-sectional view of a dispenser arrangement according to an embodiment of the present invention showing a cylindrical fluid holding area with a big actuator. Similar to FIG. 7A, the fluid holding area 112 has a rectangular cross-sectional view and a circular top view, thereby forming a cylinder. The dimensions of the cylindrical actuator 130 are only a little smaller when compared to that of the cylindrical fluid holding area 112. For a cylindrical fluid holding area 112 with a large cylindrical actuator 130, dead volume is reduced as the actuator 130 is optimized to push all the fluid out of the fluid holding area 112. But due to the size of the actuator 130, there is a large stress generated on the covering layer 120 covering the fluid holding area 112. The large stress generated may cause the covering layer 120 to tear.

Figure 8:
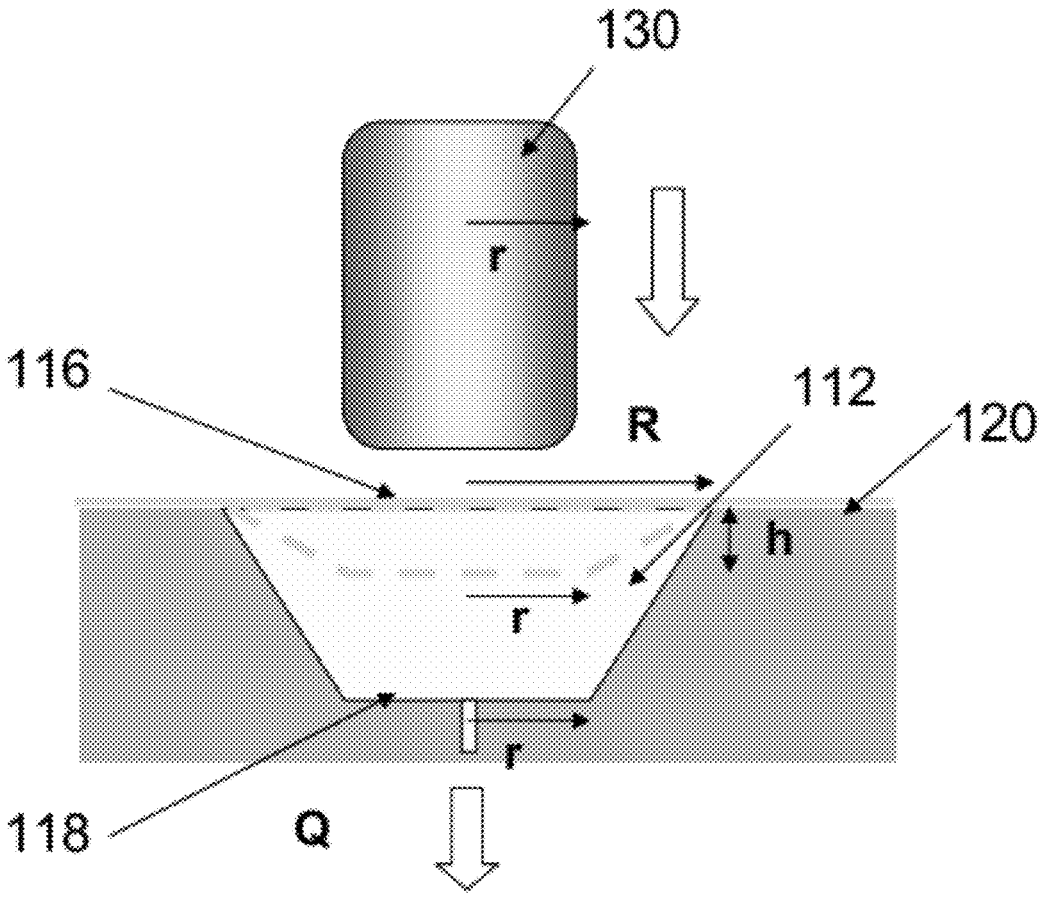
FIG. 8 shows a cross-sectional view of a dispenser arrangement according to an embodiment of the present invention showing a truncated conical fluid holding area with a small cylindrical actuator.

FIG. 8 shows a cross-sectional view of a dispenser arrangement according to an embodiment of the present invention showing a truncated conical fluid holding area with a small cylindrical actuator. The fluid holding area 112 has a trapezoidal cross-sectional view and a circular top view, thereby forming a truncated cone. The fluid holding area 112 has a base portion 116 and a top portion 118. The cylinder actuator 130 has two ends and the cross-sectional area of each end of the actuator 130 is approximately the same as the cross-sectional area of the top portion 118 of the fluid holding area 112. Having such an actuator 130 may minimize the dead volume and the stress generated on the covering layer 120 covering the fluid holding area 112 as the fluid is inclined to be pushed towards the top portion 118 and the actuator 130 will then push most of the fluid out from the fluid holding area 112 to the microfluidic channel.

The flow rate of the fluid within the fluid holding area may be controlled by the actuator displacement speed.

Using the truncated conical holding area as an example, the volume of the truncated conical fluid holding area is defined as follows:

$$\text{Volume } (V)=(R^2+rR+r^2)\times h\times\pi/3 \Rightarrow \quad \text{equation (3)}$$

Where R is radius of the base portion of the truncated conical fluid holding area r is radius of the top portion of the truncated conical fluid holding area h is distance of deformation of the covering layer covering the fluid holding area The flow rate is defined by the change in volume with time as follows:

$$\text{Flow rate } (Q)=dV/dt=[(R^2+rR+r^2)\times(\pi/3)]\times dh/dt \Rightarrow \text{equation} \quad (4)$$

The actuator speed is defined by the change in deformation of the covering layer covering the fluid holding area with time as follows:

$$\text{Actuator speed}=S=dh/dt \Rightarrow \text{equation} \quad (5)$$

Flow rate is proportional to actuator speed:

$$\text{Flow rate (Q)}=\text{constant}\times\text{actuator speed (S)} \Rightarrow \text{equation} \quad (6)$$

Therefore, the fluid flow rate out of the fluid holding area 112 into the microfluidic channel can be controlled by the speed of exerting the actuator 130 downwards on the covering layer 120 covering the fluid holding area 112. Exerting the actuator 130 downwards on the covering layer 120 thereby pushes the pin valve 100 further downwards towards the microfluidic channel substrate.

Figures 9, 10:
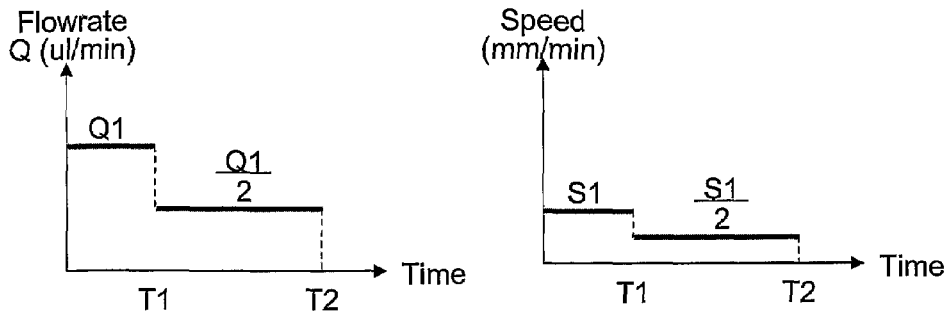
FIG. 9 shows a graph of flow rate (Q) vs time (t) and a graph of actuator speed (S) vs time (t) and their inter-relationship according to an embodiment of the present invention.
FIG. 10 shows a table tabulating respective flow rate measurements for different reagents using a dispenser arrangement according to an embodiment of the present invention.

FIG. 9 shows a graph of flow rate (Q) vs time (t) and a graph of actuator speed (S) vs time (t) and their inter-relationship according to an embodiment of the present invention. From FIG. 9, it can be observed that the flow rate (Q1) is proportional to actuator speed (Si) in time T1 . When flow rate (Q1) is halved in time T2, actuator speed (S1) is also halved accordingly.

FIG. 10 shows a table tabulating respective flow rate measurements for different reagents using a dispenser arrangement according to an embodiment of the present invention. Different reagents are housed in the fluid holding area or reservoir respectively. From the table 140, the reagents measured using the dispenser arrangement include high salt, ethanol, air and water. The required flow rate in microlitre per minute (μl/min) for high salt, ethanol, air and water is 50 μl/min, 50 μl/min, 100 μl/min and 2 μl/min respectively. The actuator or piston speed calculated based on the required flow rate in millimeters per minute (mm/min) for high salt, ethanol, air and water is 0.513 mm/min, 0.628 mm/min, 2.2 mm/min and 0.0437 mm/min respectively. The experimental flow rate obtained using the dispenser arrangement for high salt, ethanol, air and water is 47.24 μl/min, 38.27 μl/min, 85.64 μl/min and 1.52 μl/min respectively, which is quite close to the required flow rate. From the table 140, it can be seen that the flow rate out of the fluid holding area is related to the piston speed.

Figure 11:
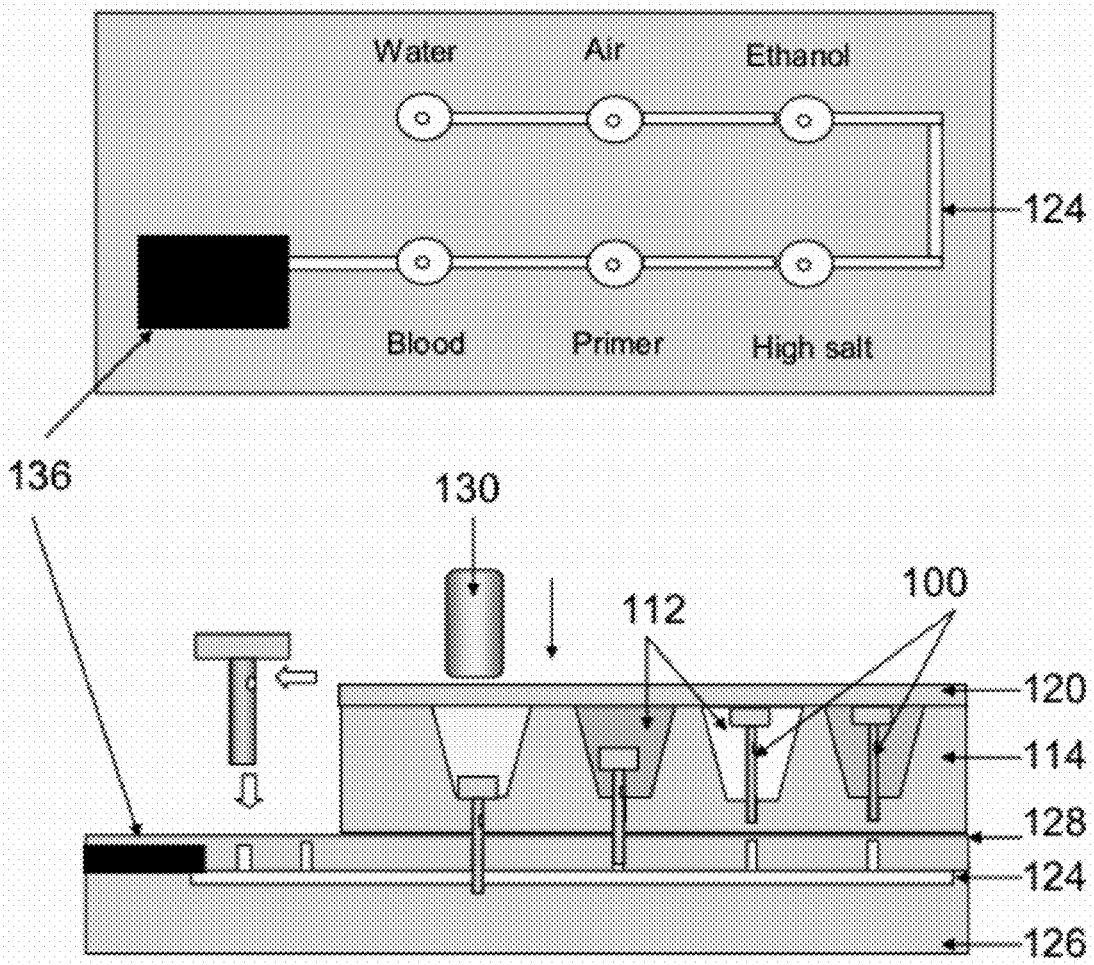
FIG. 11 shows top and cross-sectional views of a microfluidic package having a plurality of dispenser arrangements according to an embodiment of the present invention.

A plurality of dispenser arrangements can be arranged in a microfluidic package. The microfluidic package can be made from the same material or from a combination of different materials before being aligned together. FIG. 11 shows top and cross-sectional views of a microfluidic package having a plurality of dispenser arrangements according to an embodiment of the present invention. Fluid holding areas 112 are formed on a PDMS substrate 114 by casting or soft lithography techniques. The microfluidic channel 124 is formed on another PDMS substrate 126 by casting or soft lithography techniques. The substrates 114, 126 are aligned and bonded using a double-sided biocompatible tape 128, for example. A good sealing at the bonding interfaces is essential to prevent leakage. The biocompatible tape 128 can also be used to bond a chip 136 to the PDMS substrate 126 housing the microfluidic channel 124. An example of a chip can be found in U.S. patent application Ser. No. 10/818532. A pin valve 100 is housed in each fluid holding area 112. The pin valve 100 may be formed with a biocompatible material and may be easily integrated into the respective fluid holding area 112 using a pick and place machine, for example. The fluid holding areas 112 may be filled with respective reagents or fluids depending on requirements and sealed by a thin covering layer 120 made of PDMS or an elastomer material. The enclosed fluid holding area 112 allows for pre-storage of reagents and eliminates contamination from external sources. An example of a particular protocol might involve reagents like, blood, primer, high salt, ethanol, air and water housed sequentially in the fluid holding areas, with blood being nearest to the chip. However, the order or arrangement in the fluid holding area or the order of dispensing can be altered to cater to any desired requirements. An external actuator 130 is used to activate the pin valve 100 sequentially or in any desired order.

Figure 12:
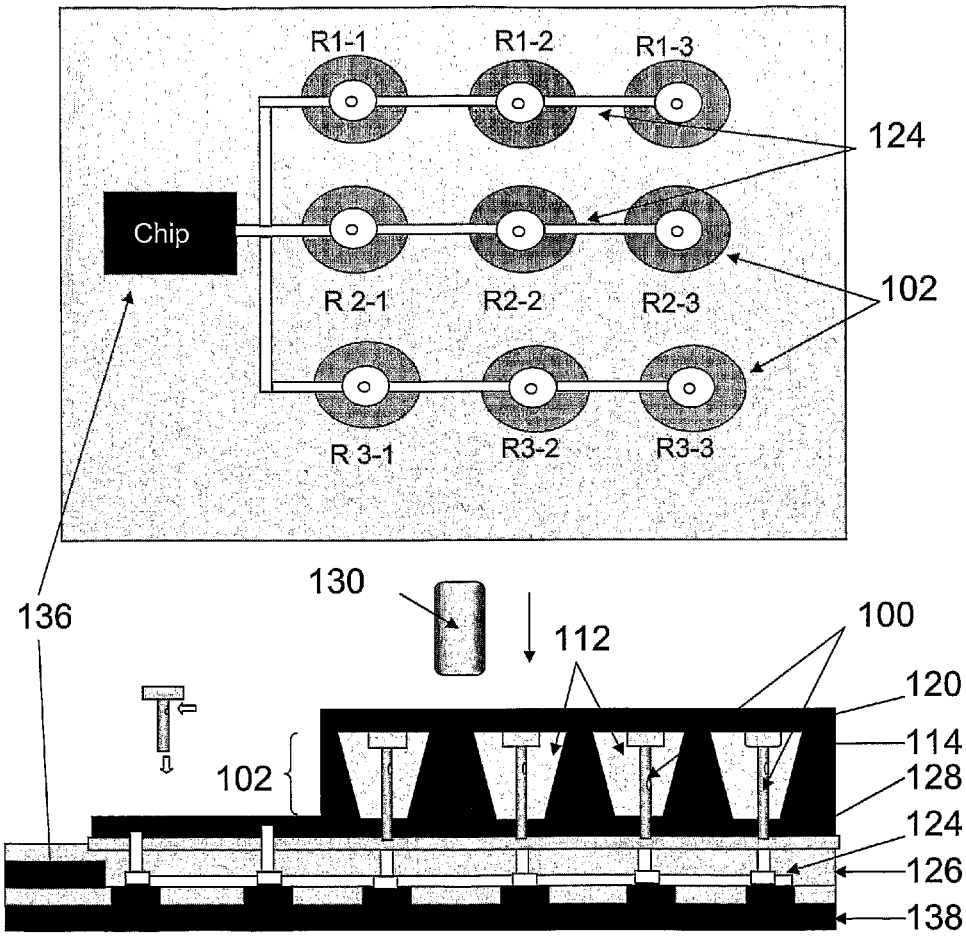
FIG. 12 shows top and cross-sectional views of a microfluidic package having a plurality of dispenser arrangements according to another embodiment of the present invention.

FIG. 12 shows top and cross-sectional views of a microfluidic package having a plurality of dispenser arrangements according to another embodiment of the present invention. Fluid holding areas 112 and microfluidic channel 124 are formed on respective substrate 114, 126 made of materials other than PDMS. Examples of the other substrate materials include thermoplastic or an elastomer material, for example COC, PC. Fabrication of the respective fluid holding areas 112 and microfluidic channels 124 is possible using high throughput process including but not limited to microinjection molding and hot embossing. In FIG. 12, the substrate 114 housing the fluid holding areas 112 may be formed from elastomer material and the substrate 126 housing the microfluidic channel 124 may be formed from thermoplastic or elastomer materials, for example COC or PC. The respective substrates 114, 126 are aligned before being bonded by a double sided biocompatible tape 128. The biocompatible tape 128 can also be used to bond a chip 136 to the substrate 126 housing the microfluidic channel 124. The substrate 126 housing the microfluidic channel 124 may be supported by another supporting layer 138, for example a layer made of an elastomer material. A pin valve 100 is housed in each fluid holding area 112. The pin valve 100 may be formed with biocompatible material and may be easily integrated into the fluid holding areas 112 using a pick and place machine, for example. The fluid holding areas 112 may be filled with respective reagents or fluids depending on requirements and sealed by a thin covering layer 120 made of elastomer material, for example. An external actuator 130 is used to activate the pin valve 100 sequentially or in any desired order. From the top view of the microfluidic package, the dispenser arrangements 102 may be arranged in a plurality of rows for dispensing one or more than one sequence of fluids or reagents to the chip 136 at any one time, but this is not so limited. The dispenser arrangements 102 may also be arranged in any desired arrangement depending on requirements.

Figure 13:
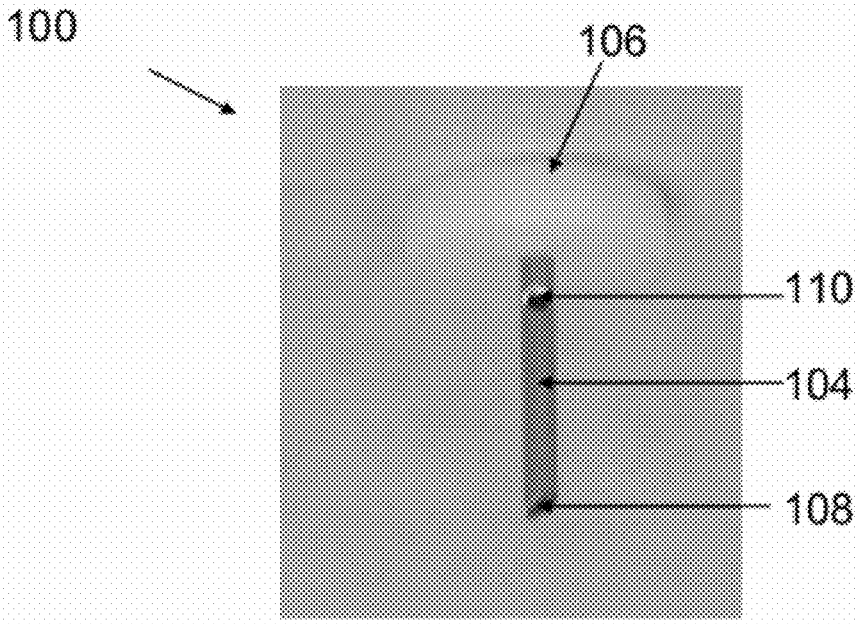
FIG. 13 shows a cross-sectional view of a valve of a dispenser arrangement as fabricated according to an embodiment of the present invention.

FIG. 13 shows a cross-sectional view of a pin valve of a dispenser arrangement as fabricated according to an embodiment of the present invention. The pin valve 100 comprises an elongated hollow portion 104 having a body and two ends. A sealing portion 106 is positioned at an end of the hollow portion 104 and the other end of the hollow portion 104 is an opening with a slant tip 108. Another opening 110 is present on the body of the hollow portion 104, nearer to the sealing portion 106. The elongated hollow portion 104 is made of metal while the sealing portion 106 is made of plastic.

Figure 14:
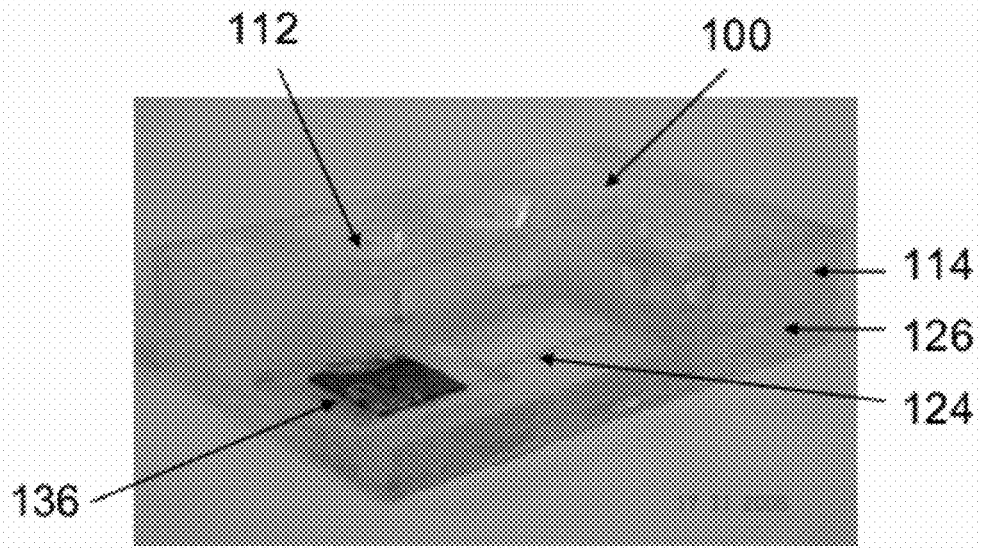
FIG. 14 shows a perspective view of a microfluidic package having a plurality of dispenser arrangements as fabricated according to an embodiment of the present invention.

FIG. 14 shows a perspective view of a microfluidic package having a plurality of dispenser arrangements as fabricated according to an embodiment of the present invention. The substrates 114, 126 housing the fluid holding areas 112 and the microfluidic channel 124 are made of PDMS for example. PDMS has been selected due to the flexibility in fabrication of microfluidic channels by casting or soft lithography techniques. PDMS is also a biocompatible material and thereby suitable for medical devices. The soft, flexible and highly elastic nature allows good sealing of microfluidic system and minimizes fluidic leakage. The transparent material also facilitates optical detection of flow in the package. The pin valve 100 is positioned within the fluid holding area 112 and a biochip 136, for example a DNA extraction chip or RNA extraction chip is attached to the substrate 126 housing the microfluidic channel 124 using a double sided biocompatible tape.

Figure 15:
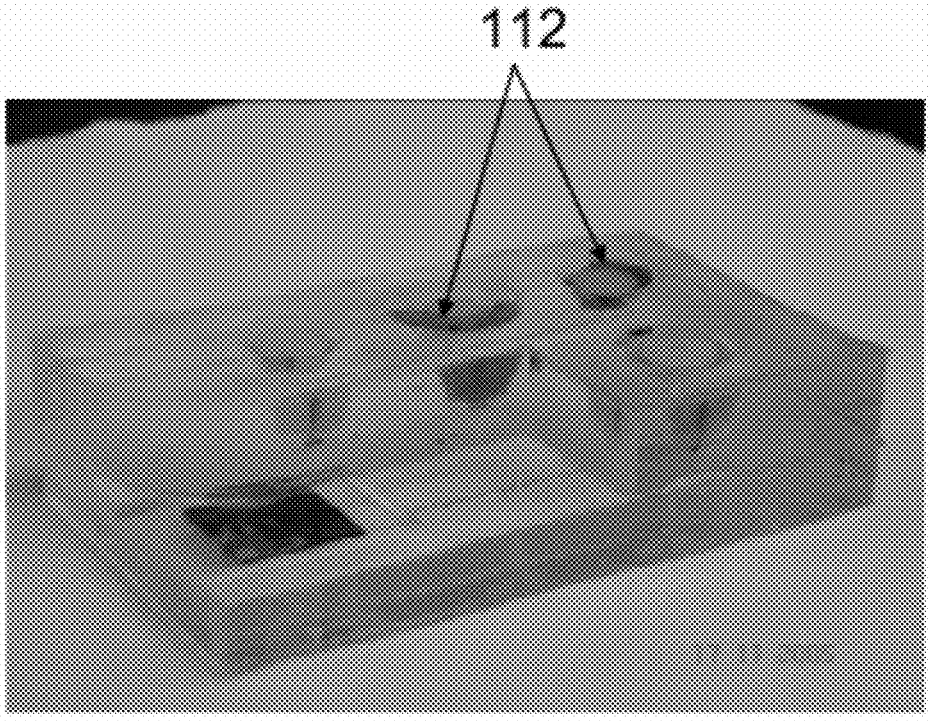
FIG. 15 shows a perspective view of a microfluidic package having a plurality of dispenser arrangements which has been filled with fluids as fabricated according to an embodiment of the present invention.

FIG. 15 shows a perspective view of a microfluidic package having a plurality of dispenser arrangements which has been filled with fluids as fabricated according to an embodiment of the present invention. Different fluids may be pre-stored in the respective fluid holding areas 112 according to a desired protocol. After the fluids have been pre-stored in the fluid holding areas 112, the fluid holding area 112 is sealed by a thin covering layer to prevent any leakage or contamination.

Figure 16:
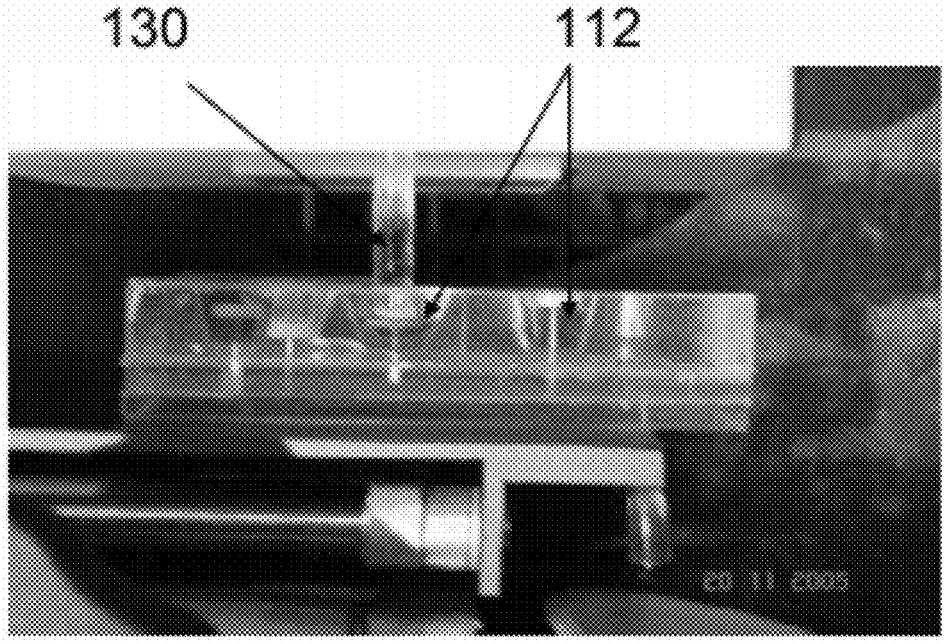
FIG. 16 shows a perspective view of a microfluidic package having a plurality of dispenser arrangements where an external actuator is used to apply pressure on covering layer covering a fluid holding area to push fluid from the fluid holding area into a microfluidic channel according to an embodiment of the present invention.

FIG. 16 shows a perspective view of a microfluidic package having a plurality of dispenser arrangements where an external actuator is used to apply pressure on covering layer covering a fluid holding area to push fluid from the fluid holding area into a microfluidic channel according to an embodiment of the present invention. The external actuator 130 may be moved from above one fluid holding area 112 to another fluid holding area 112 sequentially or depending on the order of desired dispersing.

Figure 17:
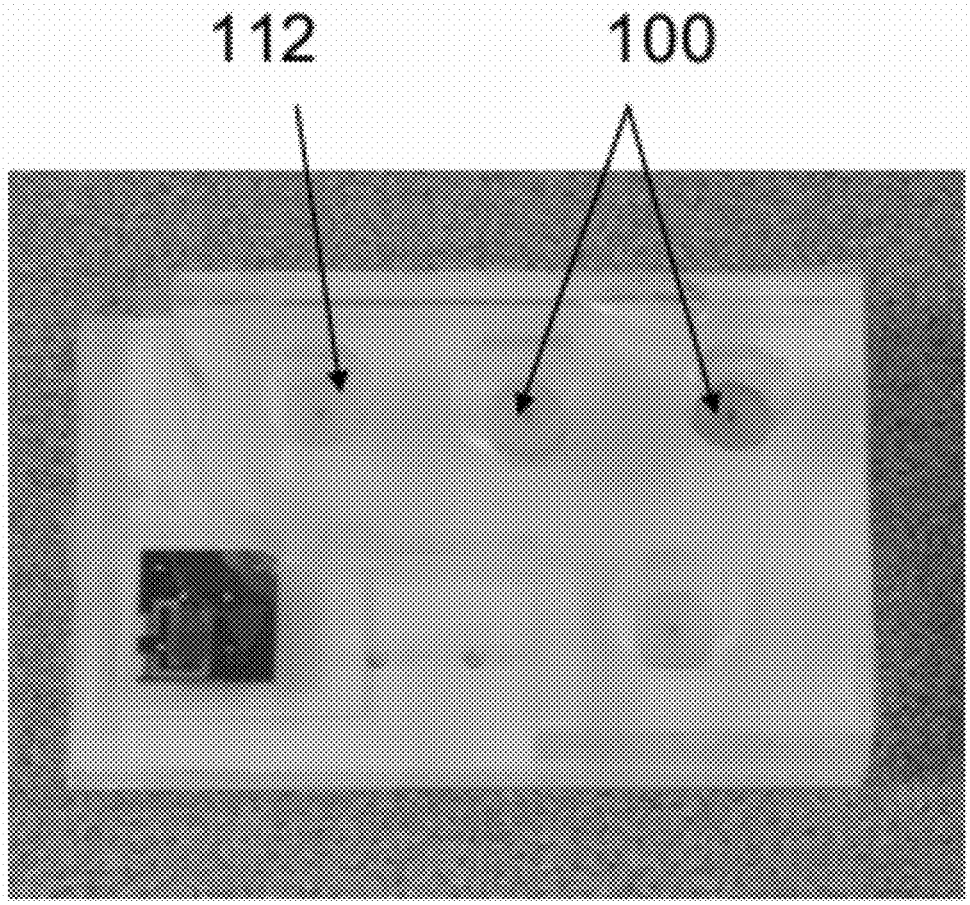
FIG. 17 shows a top view of a microfluidic package having a plurality of dispenser arrangements when in use according to an embodiment of the present invention.

FIG. 17 shows a top view of a microfluidic package having a plurality of dispenser arrangements when in use according to an embodiment of the present invention. Four dispenser arrangements, each comprising a fluid holding area 112 and a pin valve 100 is shown in FIG. 17. No cross contamination or mixing of fluids is observed after the respective fluids in the fluid holding areas 112 have been dispensed.

The aforementioned description of the various embodiments has been presented for purposes of illustration and description. It is not intended to be exhaustive or to limit the invention to the precise form disclosed, and obviously many modifications and variations are possible in light of the disclosed teaching. It is intended that the scope of the invention be defined by the claims appended hereto.

We claim:

1. A dispenser arrangement for fluidic dispensing control into a microfluidic component comprising:

an enclosed fluid holding area; and a valve adapted to be movable between an open position and a closed position and positioned at least partially in the fluid holding area, said valve comprising:

an elongated hollow portion having a body and two ends adapted for fluid flow from the fluid holding area to the microfluidic component in the open position;

wherein a first end of the hollow portion is sealed such that it prevents fluid from entering the first end and wherein the first end is positioned within the fluid holding area;

a first opening on the body of the hollow portion positioned within the fluid holding area allowing fluid communication from the fluid holding area to the microfluidic component in the open position; and a slant second opening at a second end of the hollow portion positioned outside of the fluid holding area wherein the slant second opening is adapted to pierce through a sealing layer covering the microfluidic component in the open position and to insert into a first substrate housing the microfluidic component in the closed position.

2. The dispenser arrangement of claim 1, wherein the valve is movable between a first closed position where the valve is not in contact with the microfluidic component and a second closed position where the valve is in sealing connection with the microfluidic component when a force is exerted on the first end of the hollow portion.

3. The dispenser arrangement of claim 2, wherein the open position is an intermediate position between the first closed position and the second closed position.

4. The dispenser arrangement of claim 1, wherein in the open position, the slant second opening of the valve engages the microfluidic component, thereby allowing fluid communication from the fluid holding area to the microfluidic component.

5. The dispenser arrangement of claim 4, wherein in the open position, the fluid communication allows fluid in the fluid holding area to flow in from the first opening and to flow out from the slant second opening into the microfluidic component.

6. The dispenser arrangement of claim 1, wherein the first substrate comprises a deformable material or wherein the first substrate comprises a rigid material.

7. The dispenser arrangement of claim 6, wherein the deformable material comprises an elastomer material.

8. The dispenser arrangement of claim 1, wherein the enclosed fluid holding area is formed within a second substrate.

9. The dispenser arrangement of claim 8 wherein the second substrate comprises a deformable material or wherein the second substrate comprises a rigid material.

10. The dispenser arrangement of claim 9, wherein the deformable material comprises an elastomer material.

11. The dispenser arrangement of claim 8, wherein the first substrate and the second substrate are adapted to be bonded by bonding means.

12. The dispenser arrangement of claim 11, wherein the bonding means comprises a double sided tape, glue, clipping means, or the substrates are adapted to be bonded by pressure means, temperature means, ultrasonic means, thermosonic means, thermocompression means, laser welding means, transfer molding means, overmolding or injection molding.

13. The dispenser arrangement of claim 1, wherein the enclosed fluid holding area is covered by a covering layer.

14. The dispenser arrangement of claim 13, wherein the covering layer comprises a deformable material or wherein the covering layer comprises a rigid material.

15. The dispenser arrangement of claim 14, wherein the deformable material comprises an elastomer material.

16. The dispenser arrangement of claim 13, wherein the covering layer is situated above the hollow portion and comprises a reinforced portion arranged such that it is in contact with the first end of the hollow portion when a force is exerted on the covering layer.

17. The dispenser arrangement of claim 16, wherein the reinforced portion is of the same material as the covering layer but is thicker in dimensions or wherein the reinforced portion comprises of a different material from the covering layer.

18. The dispenser arrangement of claim 1, wherein the enclosed fluid holding area comprises a base portion and a top portion.

19. The dispenser arrangement of claim 18, wherein the top portion of the enclosed fluid holding area is proximal to the microfluidic component.

20. The dispenser arrangement of claim 18, wherein the base portion of the enclosed fluid holding area is distal from the microfluidic component.

21. The dispenser arrangement of claim 1, wherein sealing of the first end is provided by a sealing portion connected to a first end of the hollow portion positioned within the fluid holding area.

22. The dispenser arrangement of claim 2, wherein the first opening on the body of the hollow portion is sealed by the first substrate in the second closed position.

23. The dispenser arrangement of claim 2, wherein the slant second opening at the second end of the hollow portion is sealed by the first substrate in the second closed position.

24. The dispenser arrangement of claim 1, wherein from the top-view, the fluid holding area has an essentially circular cross-sectional shape or a polygonal cross-sectional shape.

25. The dispenser arrangement of claim 1, wherein from the side-view, the fluid holding area has a polygonal cross-sectional shape.

26. The dispenser arrangement of claim 18, wherein the base portion has a wider cross-section area than the top portion.

27. The dispenser arrangement of claim 1, wherein the fluid holding area is a truncated cone.

28. The dispenser arrangement of claim 1, wherein the microfluidic component is adapted to accommodate the body of the hollow portion at an engagement region where the slant second opening of the valve engages the microfluidic component in the open position.

29. The dispenser arrangement of claim 28, wherein the engagement region has a dimension larger than the body of the hollow portion.

30. The dispenser arrangement of claim 2, wherein the force is provided by an actuator.

31. The dispenser arrangement of claim 30, wherein the actuator comprises a piston, an integrated micropump, or the actuation is achieved by electrostatic means, pneumatic means, hydraulic means, electrical means, chemical means, thermal means, optical means or physical means.

32. A dispenser unit comprising:

the dispenser arrangement as defined in claim 1; and an actuator.

33. The dispenser unit of claim 32, wherein the actuator is a cylinder having two ends.

34. The dispenser unit of claim 33, wherein the cross-sectional area of each end of the cylinder is approximately the same as the cross-sectional area of a top portion of a enclosed fluid holding area.

* * * * *